United States Patent [19]

Torres

[11] Patent Number: 5,071,499

[45] Date of Patent: Dec. 10, 1991

[54] RADIO-OPAQUE EXPLOSIVES, EXPLOSIVE DEVICES, AND WEAPONS

[75] Inventor: James E. Torres, Baton Rouge, La.

[73] Assignee: Ethyl Corporation, Richmond, Va.

[21] Appl. No.: 564,130

[22] Filed: Aug. 7, 1990

[51] Int. Cl.[5] ..... D03D 23/00

[52] U.S. Cl. ..... 149/109.4; 149/109.6; 149/123

[58] Field of Search ..... 149/109.6, 123, 109.4

[56] References Cited

U.S. PATENT DOCUMENTS

| | | | |
|---|---|---|---|
| 3,712,233 | 1/1973 | Drake et al. | 149/7 |
| 3,920,575 | 11/1975 | Shiki et al. | 149/35 |
| 3,972,820 | 8/1976 | Filter et al. | 149/87 |
| 4,703,826 | 11/1987 | Byron | 89/188 |
| 4,838,143 | 6/1989 | Byron | 89/14.3 |
| 4,926,739 | 5/1990 | Byron | 89/1.4 |

OTHER PUBLICATIONS

Chemical Abstract 112:78728u, "Manufacture of Flame-Retardant, Radiation-Resistant Polymer Compositions".

Publication, Modern Plastics, vol. 63, No. 7, Jul. 1986, pp. 10–11.

*Primary Examiner*—Stephen J. Lechert, Jr.

*Attorney, Agent, or Firm*—Davaid E. LaRose; Richard L. Hansen

[57] ABSTRACT

This invention relates to a method for rendering explosives and weapons radio-opaque so as to allow their detection by low level x-ray machines.

15 Claims, No Drawings

RADIO-OPAQUE EXPLOSIVES, EXPLOSIVE DEVICES, AND WEAPONS

BACKGROUND

This invention relates to a method for detecting plastic explosives and weapons using an x-ray machine Terrorist activity throughout the world has resulted in a rise in sophisticated methods for concealing weapons, explosives, and explosive devices in luggage or other containers which are then placed on buses, trains and airplanes as well as left in airports and other public buildings. Some of the weapons, explosives, and explosive devices now used are undetectable by x-ray machines since they are comprised, almost entirely of materials other than metals, e.g. ceramics, plastics and/or polymeric materials. Examples of such devices and weapons include plastic explosives and plastic pistols.

Current methods for the detection of explosives, explosive devices and weapons which are undetectable by x-ray machines include the use of trained dogs and experimental detection machines that can only detect certain kinds of explosives and explosive devices. The experimental machines are not only limited in their use, but are quite expensive. Hence the cost of placing these experimental machines in the airports, bus and train stations throughout the world may be prohibitive. There is a need therefore for an facile economic means for rendering weapons, explosives and explosive devices opaque to the electromagnetic radiation emitted by now existing x-ray machines which machines are currently being used in airports and other public buildings for the detection of weapons, explosives, and explosive devices.

THE INVENTION

A method has now been discovered for rendering a macromolecular formulation used in the production of an explosive, explosive device, or weapon radio opaque which method comprises adding a bromine containing product to the formulation in an amount such that the article is detectable by an x-ray machine.

In another embodiment, this invention provides a radio-opaque formulation for use in producing an explosive or explosive device, the formulation comprising a polymeric material and an amount of bromine containing product sufficient to render the explosive or explosive device radio-opaque.

It is preferred that the bromine containing product be a metal bromide or a product predominant in an polybrominated aromatic or cycloaliphatic compound. Of the metal bromide compounds, the more preferred are sodium bromide, zinc bromide, barium bromide, calcium bromide, or mixtures thereof, with zinc bromide, barium bromide, sodium bromide, or mixtures thereof being the most preferred. Polybrominated aromatic or cycloaliphatic compounds which are more preferred are the products predominant in octabromodiphenyl oxide, decabromodiphenyl oxide, tetradecabromodiphenoxy benzene, octabromodiphenylethane, decabromodiphenylethane, decabromodiphenylmethane, tetrabromophthalic anhydride, N,N'-bis(tetrabromophthalimide), N,N'-alkylene-bis(tetrabromophthalimide), tetrabromobisphenol-A, 1,2,4,6,9,10-hexabromocyclododecane, tetrabromocyclooctane, dibromoethyldibromocyclohexane, dibromomethyldibromocyclopentane, pentabromodiphenyl oxide, pentabromochloroocyclohexane, hexabromocyclohexane, tetrabromodichlorocyclohexane, monobromopentaerythritol, dibromoneopentyl glycol, tribromoneopentyl alcohol, or mixtures thereof. Of the foregoing products, the most preferred products are those products predominant in octabromodiphenyl oxide, decabromodiphenyl oxide, decabromodiphenylethane, 1,2,5,6,9,10-hexabromocyclododecane, tetrabromobisphenol-A, N,N'-bis(tetrabromophthalimide), N,N'-ethylenebis(tetrabromophthalimide), dibromoneopentyl glycol or mixtures thereof.

The amount of bromine containing product used in the formulation is that amount required to render the formulation radio-opaque so that an explosive, explosive device, or weapon made from the formulation may be detectable by a low level x-ray machine. The preferred amount of bromine containing product in the formulation is that amount which will provide at least about 0.1 weight percent of bromine based on the total weight of the formulation. A more preferred amount of bromine in the formulation is at least about 0.5 weight percent with the most preferred amount being at least about 1.0 weight percent of total bromine. The formation may contain more bromine, than about 1 percent by weight, however, it is less costly and more economical to utilize only that amount of bromine containing product which will render the formulation radio-opaque.

For the purposes of this invention, a low-level x-ray machine is defined as a machine which emits about 0.01 milliRoentgen (mR). In comparison, the radiation leakage from a television tube at 5 centimeters is about 0.05 mR/hr and a routine dental x-ray machine provides an exposure of about 25 mR.

The formulation which is rendered radio-opaque may be macromolecular, for example, a cellulosic material or a polymer. Illustrative polymers are: olefin polymers, cross-linked and otherwise, for example, homopolymers of ethylene, propylene, and butylene; copolymers of one or more of such alkylene monomers and any other copolymerizable monomers, for example, ethylene/propylene copolymers, ethylene/ethyl acrylate copolymers and ethylene/vinyl acetate copolymers; polymers of olefinically unsaturated monomers, for example, polystyrene, e.g. high impact polystyrene, and styrene copolymers; polyurethanes; polyamides; polyimides; polycarbonates; polyethers; acrylic resins; polyesters, especially poly(ethyleneterephthalate) and poly(-butyleneterephthalate); epoxy resins; alkyls; phenolics; elastomers, for example, butadiene/styrene copolymers and butadiene/acrylonitrile copolymers; terpolymers of acrylonitrile, butadiene and styrene; natural rubber; butyl rubber; and polysiloxanes. The polymer may also be a blend of various polymers. Further, the polymer may be, where appropriate, cross-linked by chemical means or by irradiation.

In addition to polymeric or cellulosic materials, the formulation may also contain ceramic materials and glass fibers for thermal stability and strength.

The radio-opaque formulations of this invention can be conventionally prepared using art-recognized blending equipment, e.g., a Brabender mixer. The various constituents can be added to the selected piece of equipment one at a time, all at once or in any combination.

Any of the additives usually present in plastic formulations, e.g. antioxidants, fillers, pigments, UV stabilizers, dyes, anti-static agents, plasticizers, flow-improves, etc. can be used in the radio-opaque formulation of this invention.

Polymeric or thermoplastic weapons, explosives, and explosive devices made from radio-opaque formulations of this invention can be produced conventionally, e.g. by injection molding, extrusion molding, compression molding, and the like.

The following Example merely illustrates the use of a bromine containing compound to prepare a radio-opaque device by the method of this invention and is not to be taken as limiting such invention.

EXAMPLE

Test plaques were prepared from a general purpose high impact polystyrene (HIPS) resin. Three of the test plaques contained Saytex® 102FR (decabromodiphenyl oxide of Ethyl Corporation). Plaque 1 contained 1.0 weight percent Saytex® 102FR (0.83 weight percent Br) and 99.0 weight percent HIPS, plaque 2 contained 5.0 weight percent Saytex® 102FR (4.15 weight percent Br) and 95.0 weight 5 HIPS, and plaque 3 contained 10.0 weight percent Saytex® 102FR (8.3 weight percent Br) and 90 weight percent HIPS. The fourth test plaque was 100 weight percent HIPS and represented the control plaque. The test consisted of visual observation of the irradiated image as the plaques were passed through a Scanray X-Ray machine, model 01-0410. This machine was operated with a 90 kV emission source.

What was observed is that the control plaque (100 weight percent HIPS) was virtually transparent to the x-ray machine. In contrast, all three of the bromine containing plaques produced distinct, black images on the monitor when irradiated. The intensity of the image on the monitor increased as the bromine content of the test plaque increased.

Variations in the invention are within the spirit and scope of the appended claims.

What is claimed is:

1. A method for rendering a formless, unstructured macromolecular formulation used in the production of an explosive, explosive device, or weapon radio-opaque, which method comprises adding a bromine containing product to the formulation in an amount such that the bromine content of the formulation is at least about 1.0 weight percent, but no greater than about 8.3 weight percent.

2. The method of claim 1 wherein the bromine containing product is predominant in octabromodiphenyl oxide, decabromodiphenyl oxide, or decabromodiphenylethane.

3. The method of claim 1 wherein the bromine containing product is zinc bromide, barium bromide, or sodium bromide.

4. The method of claim 1 wherein the bromine containing product is predominant in N,N'-ethylenebis(tetrabromopthalimide) or N,N'-bis(tetrabromophthalimide).

5. The method of claim 1 wherein the bromine containing product is predominant in tetrabromobisphenol-A.

6. The method of claim 1 wherein the bromine containing product is predominant in hexabromocyclododecane.

7. The method of claim 1 wherein the bromine containing product is predominant in dibromoneopentyl glycol.

8. The method of claim 1 wherein the macromolecular formulation is comprised of a general purpose high impact polystyrene.

9. A formless, unstructured radio-opaque formulation for an explosive or explosive device comprising a polymeric material and an amount of a bromine containing product such that the bromine content of the formulation is at least about 1.0 weight percent, but no greater than about 8.3 weight percent.

10. The formulation of claim 9 wherein the bromine containing product is a product predominant in octabromodiphenyl oxide, decabromodiphenyl oxide, or decabromodiphenylethane.

11. The formulation of claim 9 wherein the bromine product is zinc bromide, barium bromide, or sodium bromide.

12. The formulation of claim 9 wherein the bromine containing product is predominant in N,N'-ethylene(tetrabromophthalimide) or N,N'-bis(tetrabromophthalimide).

13. The formulation of claim 9 wherein the bromine containing product is predominant in tetrabromobisphenol-A.

14. The formulation of claim 9 wherein the bromine containing product is predominant in hexabromocyclododecane.

15. The formulation of claim 9 wherein the bromine containing product is predominant in dibromoneopentyl glycol.

* * * * *

UNITED STATES PATENT AND TRADEMARK OFFICE

CERTIFICATE OF CORRECTION

PATENT NO. : 5,071,499

DATED : DECEMBER 10, 1991

INVENTOR(S) : JAMES E. TORRES

It is certified that error appears in the above-identified patent and that said Letters Patent is hereby corrected as shown below:

Column 4, Lines 32,33 read "...the bromine product is zinc bromide,..."
and should read -- the bromine containing product is zinc bromide... --.

Signed and Sealed this

Twenty-fifth Day of May, 1993

*Attest:*

Michael K. Kirk

MICHAEL K. KIRK

*Attesting Officer*

*Acting Commissioner of Patents and Trademarks*